US009605854B2

(12) United States Patent
Zimmerman

(10) Patent No.: US 9,605,854 B2
(45) Date of Patent: Mar. 28, 2017

(54) FAN SUPPORT AND STORAGE APPARATUS

(71) Applicant: Barbara D. Zimmerman, St. Louis, MO (US)

(72) Inventor: Barbara D. Zimmerman, St. Louis, MO (US)

( * ) Notice: Subject to any disclaimer, the term of this patent is extended or adjusted under 35 U.S.C. 154(b) by 405 days.

(21) Appl. No.: 14/280,046

(22) Filed: May 16, 2014

(65) Prior Publication Data

US 2014/0250940 A1 Sep. 11, 2014

Related U.S. Application Data

(63) Continuation-in-part of application No. 13/608,552, filed on Sep. 10, 2012, now Pat. No. 8,746,917.

(51) Int. Cl.

| | |
|---|---|
| ***F24F 5/00*** | (2006.01) |
| ***A45C 11/16*** | (2006.01) |
| ***A47K 10/00*** | (2006.01) |
| ***A45D 20/00*** | (2006.01) |
| *F21V 33/00* | (2006.01) |
| *A45C 9/00* | (2006.01) |

(52) U.S. Cl.

CPC ..... *F24F 5/0035* (2013.01); *A45D 20/00* (2013.01); *A47K 10/00* (2013.01); *F24F 5/0096* (2013.01); *A45C 9/00* (2013.01); *A45C 11/16* (2013.01); *F21V 33/004* (2013.01)

(58) Field of Classification Search

CPC ..... F24F 5/0035; F24F 5/0096; A47K 10/00; A45D 20/00; A45C 9/00; A45C 11/16; F21V 33/004; F04D 29/601; F04D 29/29602

See application file for complete search history.

(56) References Cited

U.S. PATENT DOCUMENTS

| | | | | |
|---|---|---|---|---|
| 2,626,742 A * | 1/1953 | Turner | F04D 29/646 416/120 |
| 2,868,558 A * | 1/1959 | Krauss | F04D 29/646 248/129 |
| 5,090,300 A * | 2/1992 | Berenstein | A47G 1/02 359/838 |
| 5,403,162 A * | 4/1995 | Chen | F04D 25/166 248/125.1 |

(Continued)

FOREIGN PATENT DOCUMENTS

CN 203476746 U * 3/2014

*Primary Examiner* — Audrey K Bradley
(74) *Attorney, Agent, or Firm* — Dale J. Ream

(57) ABSTRACT

A fan support and storage apparatus for use in cooling a user's torso while the user is positioned adjacent the apparatus includes a base member having upper and lower portions. The apparatus includes a tubular support member having a first end operatively coupled to the base member and a second end opposite the first end. The support member has an elongate tubular configuration extending upwardly from the base member and supported in a vertical configuration above the base member. A fan assembly is slidably coupled to the support member and selectively movable therealong between the first and second ends of the support member. A fan drawer assembly is slidably coupled to the support member adjacent the fan member that is being slidably movable between the first and second ends of the support member. One or more accessory drawer assemblies may be slidably coupled to the support member.

16 Claims, 8 Drawing Sheets

(56) References Cited

U.S. PATENT DOCUMENTS

| | | | | |
|---|---|---|---|---|
| 5,558,501 | A * | 9/1996 | Wang | F04D 29/601 248/159 |
| 6,205,679 | B1 * | 3/2001 | Rodway | F26B 21/001 34/487 |
| 2008/0092737 | A1 * | 4/2008 | Storbo | B01D 53/0415 95/90 |

* cited by examiner

FAN SUPPORT AND STORAGE APPARATUS

REFERENCE TO RELATED APPLICATIONS

This non-provisional patent application claims the benefit of non-provisional application Ser. No. 13/608,552 filed on Sep. 10, 2012, titled Fan Base with Illuminated Minor and Fan and which is incorporated herein by reference in its entirety.

BACKGROUND OF THE INVENTION

This invention relates generally to personal fan devices as well as to jewelry or cosmetic storage devices. More particularly, the present invention relates to a fan support and storage apparatus that may be mounted in a bathroom or wherever a woman applies make-up or arranges her hair directly after showering, the apparatus including a fan assembly and one or more storage drawers arranged on a vertical tower framework.

A woman often applies makeup using a makeup mirror device in the bathroom immediately after showering. A problem frequently encountered with this progression of events is that the bathroom may be very hot and steamy. This can lead to a woman perspiring excessively after already showering. Further, middle aged women may also experience hot flashes that simply add to an already uncomfortable environment. In either instance, a woman may have to seek a cooler environment for a period of time which may result in being late for work or another appointment.

Another problem is that space is often very limited on a sink, vanity, or dressing table and a woman may have to make several trips to a jewelry box for accessories or to retrieve cosmetics. This problem of limited space is exaggerated if a fan is positioned on the sink—taking up precious space. For instance, a woman may desire to view or try on several different earrings, rings, necklaces, hair accessories, or the like without having to make repeated trips into the bedroom. It would also be convenient to have all cosmetics within arm's reach.

Therefore, it would be desirable to have a fan support and storage apparatus that includes a fan assembly that may be selectively directed away from a user's face and eyes while still blowing air on a user's torso. Further, it would be desirable to have a fan support and storage apparatus to which accessory drawers for storing jewelry or cosmetic accessories may be efficiently stored adjacent the fan assembly. In addition, it would be desirable to have a fan support and storage apparatus in which the fan assembly is shielded so that the user's hair or other debris are not contacted by the fan blades.

SUMMARY OF THE INVENTION

A fan support and storage apparatus according to the present invention for use in cooling a user's torso while the user is positioned adjacent the apparatus includes a base member having upper and lower portions. The apparatus includes a tubular support member having a first end operatively coupled to the base member and a second end opposite the first end. The support member has an elongate tubular configuration extending upwardly from the base member and supported in a generally vertical configuration above the base member. A fan assembly is slidably coupled to the support member and selectively movable therealong between the first end and the second end of the support member. A fan drawer assembly is slidably coupled to the support member adjacent the fan member that is being slidably movable between the first and second ends of the support member. One or more accessory drawer assemblies may be slidably coupled to the support member.

Therefore, a general object of this invention is to provide a fan support and storage apparatus to cool the torso of a person while applying cosmetics in a warm moist environment of a bathroom after showering.

Another object of this invention is to provide a fan support and storage apparatus, as aforesaid, that is mountable to a vanity surface and minor or wall in a restroom.

Still another object of this invention is to provide a fan support and storage apparatus, as aforesaid, having a fan assembly that is vertically adjustable and that can be pivoted and swiveled to a desired direction.

Yet another object of this invention is to provide a fan support and storage apparatus, as aforesaid, that includes selectively positioned drawer assemblies configured to hold jewelry or cosmetic items.

A further object of this invention is to provide a fan support and storage apparatus, as aforesaid, that provides a fan assembly and storage drawings in a vertical space that does not take up limited space on a vanity structure.

A still further object of this invention is to provide a fan support and storage apparatus, as aforesaid, that is modular in that additional drawer assemblies may be attached and vertically adjusted.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
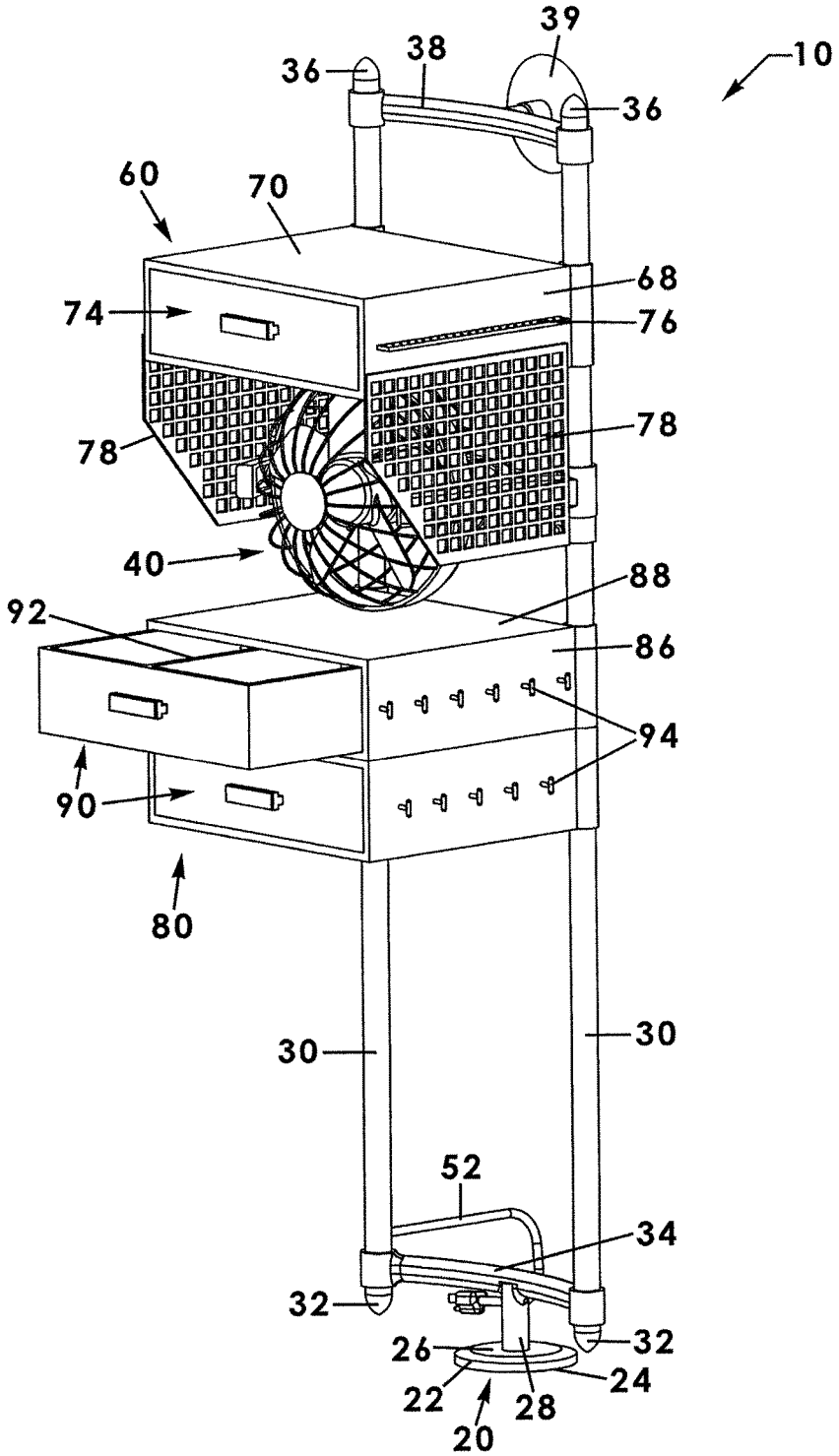
FIG. 1 is a perspective view of a fan support and storage apparatus according to a preferred embodiment of the present invention.
Figure 2A:
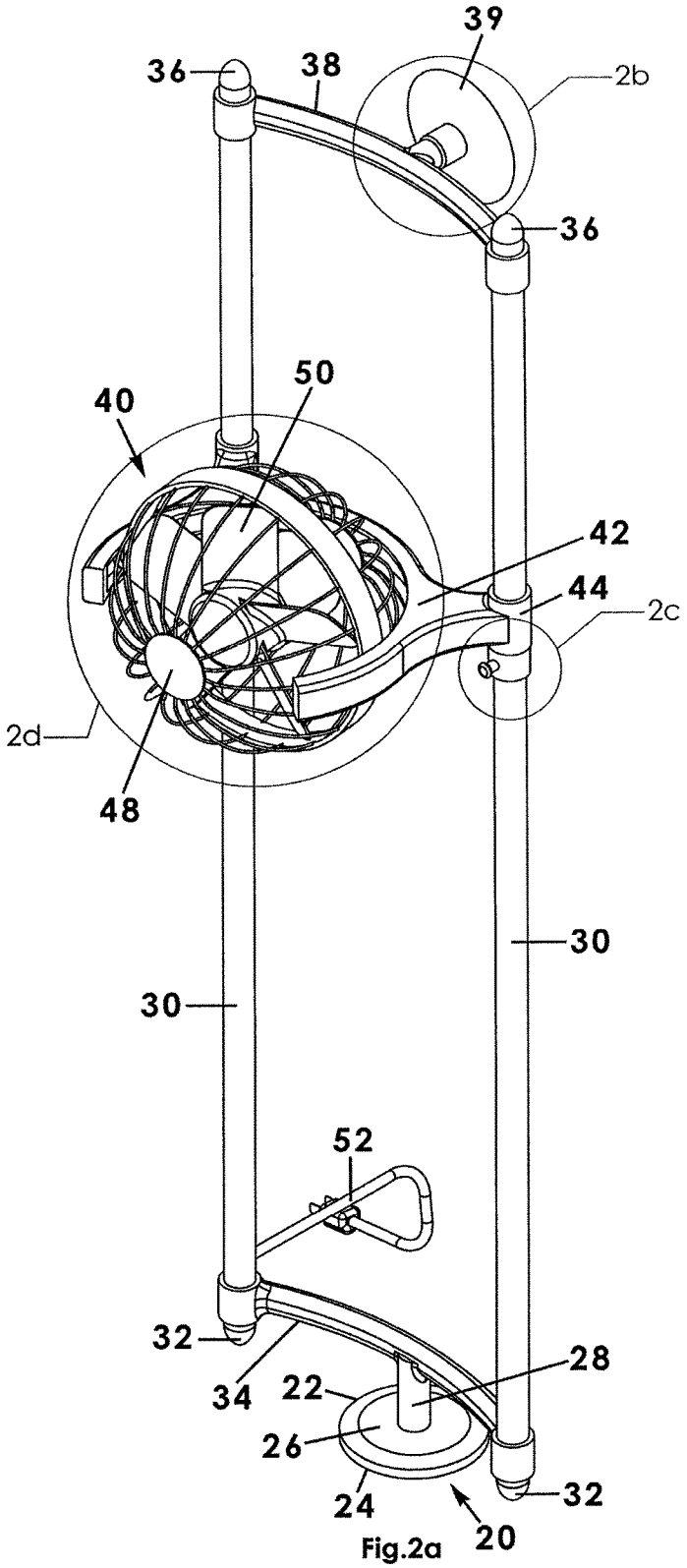
FIG. 2*a* is another perspective view of the apparatus as in FIG. 1 with all drawer assemblies removed.
Figure 2B:
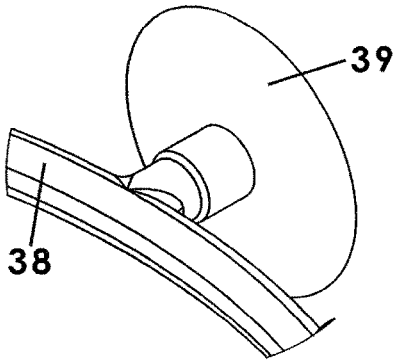
FIG. 2*b* is an isolated view on an enlarge scale taken from FIG. 2*a;*
Figure 2C:
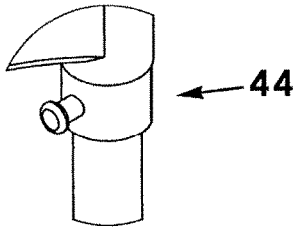
FIG. 2*c* is an isolated view on an enlarge scale taken from FIG. 2*a;*
Figure 2D:
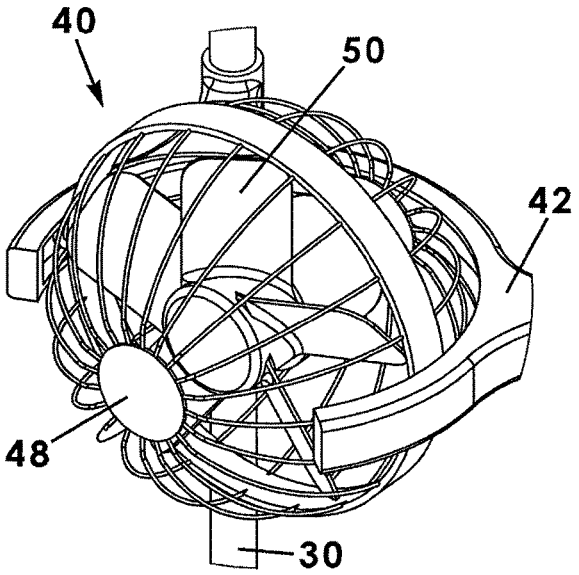
FIG. 2*d* is an isolated view on an enlarge scale taken from FIG. 2*a;*

A fan support and storage apparatus according to a preferred embodiment of the present invention will now be described with reference to FIGS. 1 to 5*d* of the accompanying drawings. The fan support and storage apparatus 10 includes a base member 20, at least one upstanding support member 30, a fan assembly, a fan drawer assembly 60, and an accessory drawer assembly 80.

The fan support and storage apparatus 10 is primarily supported by a base member 20. More particularly, the base member 20 includes a lower portion 22 having a generally planar bottom surface 24 configured to rest flat upon a support surface such as a dressing table, restroom cabinet, vanity, or the like. The lower portion 22 may also include a top surface 26 having a generally planar configuration that is generally parallel to the bottom surface 24. The base member 20 may also include an upper portion 28 extending upwardly from the lower portion 22 and may be in the form of a rod, flange, coupling, strut, or the like. Preferably, the bottom surface 24 includes a non-skid material. It is understood that the lower portion 22 may be configured to be securely fastened to the support surface on which it rests, such as with screws or the like.

At least one support member 30 extends upwardly from the base member 20. Preferably, a pair of spaced apart support members 30 extends upwardly in parallel to one another and in a generally vertical configuration above the base member 20. Each support member 30 includes a first end 32 operatively coupled to the base member 20. As shown in FIG. 1, a first connecting strut 34 is directly connected to the upper portion 28 of the base member 20 and connects first ends 32 of the support members 30.

Each support member 30 has an elongate, linear, and tubular configuration. Each support member 30 includes a second end 36 opposite respective first ends 32. A second connecting strut 38 may connect respective second ends of respective support members 30.

The connecting struts maintain the pair of support members 30 in parallel alignment. It is understood that the base member 20 and support members 30 are arranged so as to balance upon the lower portion 22 of the base member 20. In one embodiment, a mounting member is coupled to the second connecting strut 38 and is configured to selectively adhere the apparatus to a support structure such as a vanity minor or a wall. Preferably, the mounting member 39 is a suction cup although other fasteners may also be suitable.

Figure 3A:
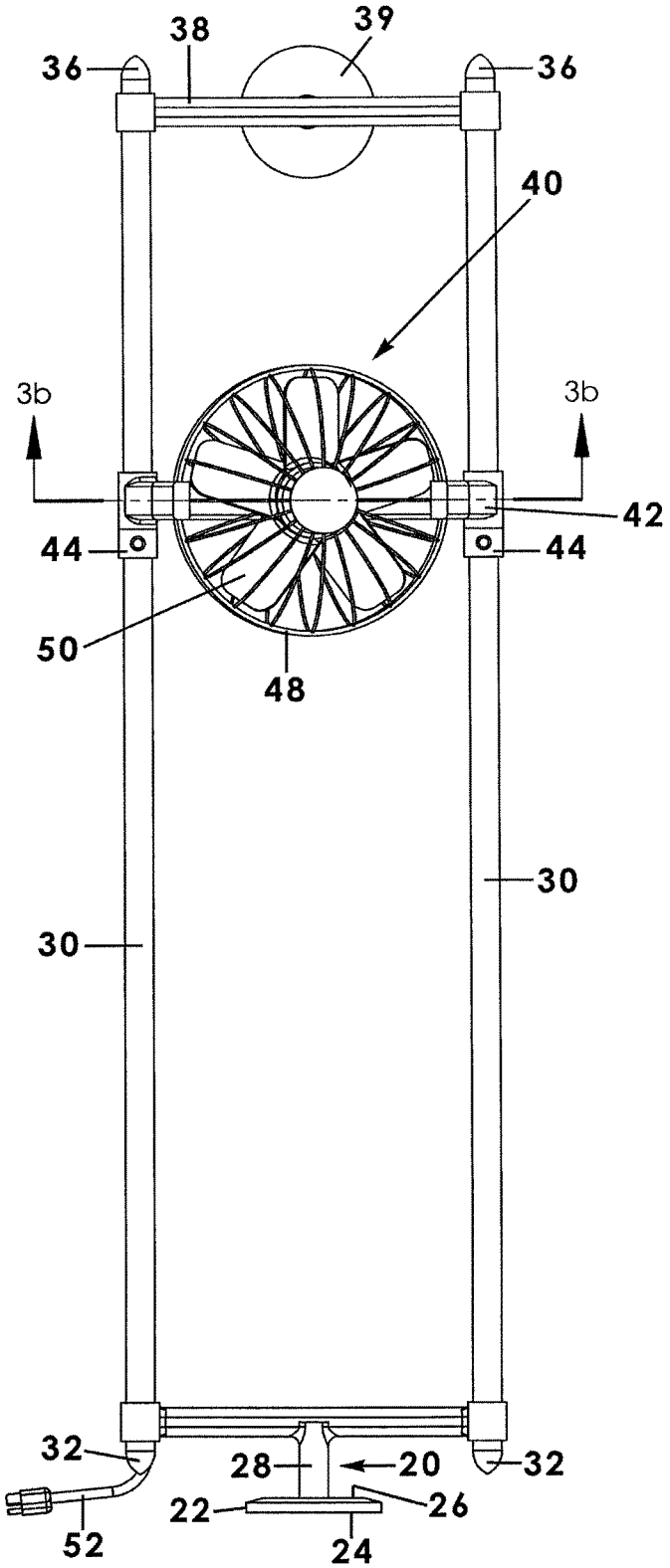
FIG. 3*a* is a front view of the apparatus as in FIG. 3*a;*
Figure 3B:
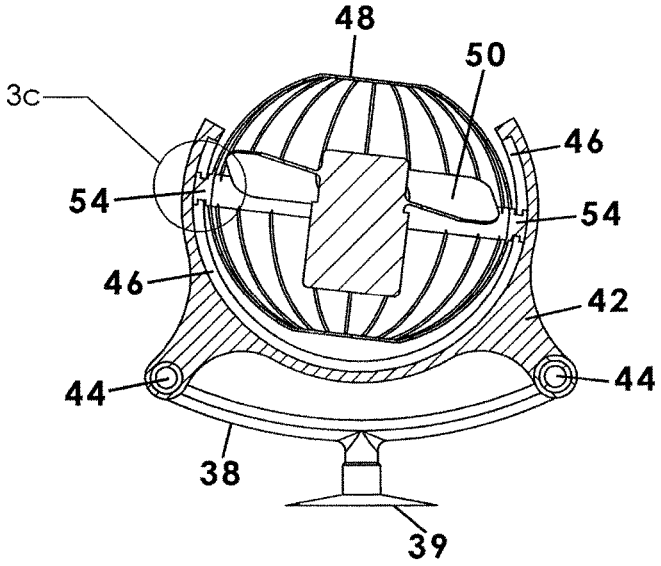
FIG. 3*b* is a sectional view taken along line 3*b*-3*b* in FIG. 3*a;*
Figure 3C:
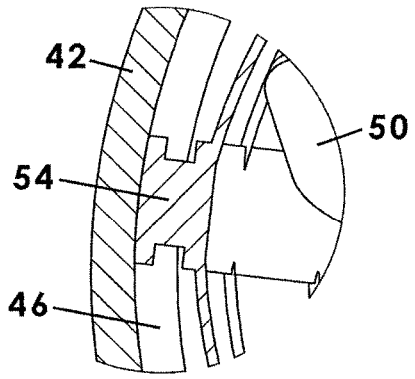
FIG. 3*c* is an isolated view on an enlarge scale taken from FIG. 3*b;*
Figure 3D:
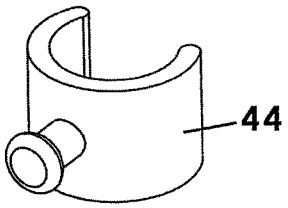
FIG. 3*d* is a perspective view of a fan assembly fastener removed from the support member.

The fan assembly 40 is operatively coupled to the support members 30 and configured to selectively slide up or down therealong between the first end 32 and second end 36, as described below. In some embodiments, the fan assembly 40 may be coupled to a single support member 30 and configured to slide vertically therealong. More particularly, the fan assembly 40 includes a carriage 42 slidably coupled to the support members 30 with a suitable fan assembly fastener 44, such as a C-shaped clip, clamp, clasp, or the like, that enables the carriage 42 to move up and down along the support members 30 and be selectively held at a selected position. In one embodiment, the fastener 44 associated with the fan assembly 40 may include a spring loaded pin as shown in FIG. 3*d*.

The fan assembly 40 includes a fan member 48 coupled to the carriage 42 that is, therefore, carried up or down along the support members 30 as the carriage 42 is moved therealong as described above. The fan member 48 includes a fan blade 50 that is rotationally movable when energized by electricity in a traditional manner. A power cord 52 may be electrically coupled to the fan member 48 and may extend through the hollow interior of a respective support member 30, the power cord 52 having a plug end configured to be electrically connected to a power source, such an AC electrical outlet.

The fan member 48 is pivotally coupled to the carriage 42 and selectively movable between an upwardly tilted, downwardly tilted, or neutral configuration. The fan assembly 40 includes a boss 54 connecting the carriage 42 to the fan member 48 or to an axle in some embodiments that is configured to enable the fan member 48 to be tilted as described above. In addition, the fan member 48 is coupled to the carriage 42 in a manner that enables the fan member to swivel to the left, to the right, or to a neutral/straight configuration. More particularly, the carriage 42 has a generally U-shaped configuration that includes an inner surface that defines a groove 46 (FIG. 3*b*). The groove 46 is configured to receive the boss 54 such that the boss 54 is slidable therein (FIG. 3*c*). This construction enables the fan member 48 to swivel side to side.

The fan drawer assembly 60 is operatively coupled to the support members 30 in a manner that enables it to move slidably between the first end 32 and second end 36 of the support members in a manner similar to that described above regarding the fan assembly 40.

More particularly, the fan drawer assembly 60 includes a fan drawer housing 62 having a rear end 64 that is removably coupled to the support members 30 with a clip 66 in a snap-fit arrangement (FIG. 4*a*) and that is selectively slidable along the support members 30. The fan drawer housing 62 includes a pair of opposed side walls 68 and opposed top 70 and bottom 72 walls. Collectively, the fan drawer walls define an open front and open interior area. The fan drawer assembly 60 also includes a fan drawer 74 that is selectively received in the interior area of the fan drawer housing 62, the fan drawer 74 having a front wall and a bottom wall that together define an interior space configured to receive articles therein. For instance, jewelry items, cosmetics, or the like may be stored inside the fan drawer 74. In addition, the fan drawer housing 62 may include a shelf member 76 or bar coupled to respective side walls of the housing, the shelf member 76 defining a plurality of holes 77 (FIG. 4*c*) configured to secure jewelry items such as ear rings (not shown).

Figure 4A:
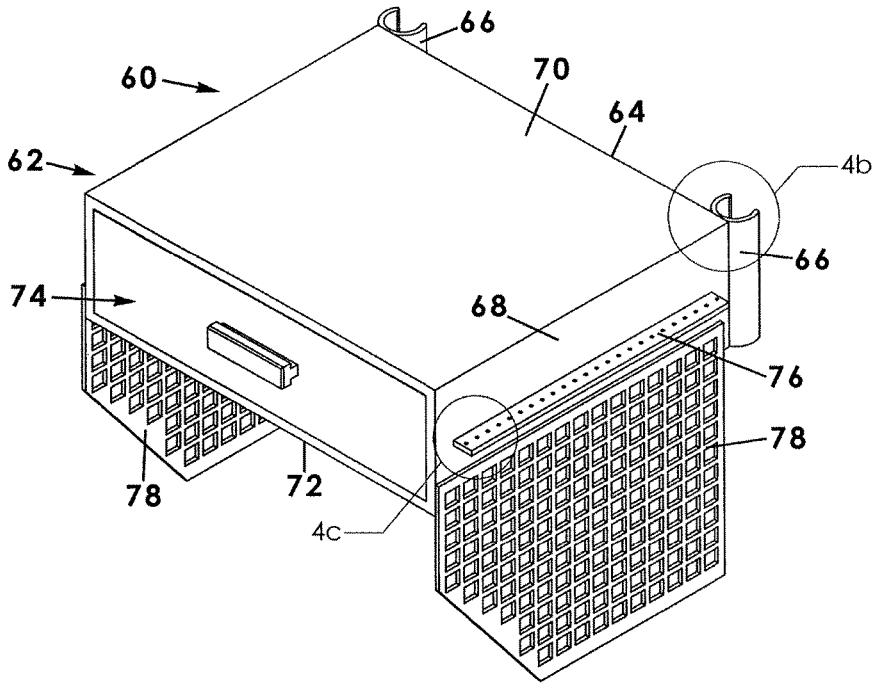
FIG. 4*a* is a perspective view of a fan drawer assembly removed from the support members.
Figure 4B:
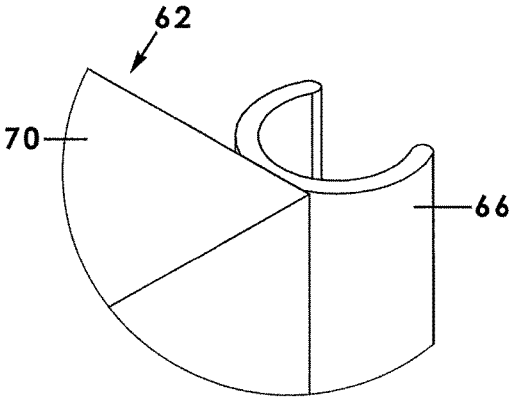
FIG. 4*b* is an isolated view on an enlarge scale taken from FIG. 4*a;*
Figure 4C:
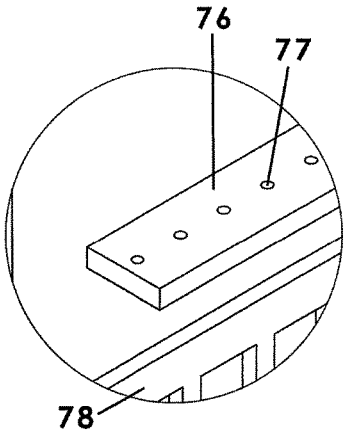
FIG. 4*c* is an isolated view on an enlarge scale taken from FIG. 4*a;*

A pair of guard members 78 extends downwardly from respective side walls 86 of the fan drawer housing 62 (FIG. 4*a*). The fan drawer assembly 60 is situated adjacent the fan assembly 40, such as upwardly adjacent, such that the guard members 78 shield lateral sides of the fan assembly 40. Each guard member 78 may be constructed of a mesh material or is a screen or grate that prevents debris, a user's hair, or the like from interacting with the fan member 48. In one embodiment, the fan drawer assembly 60 is coupled to the fan assembly 40 such that the fan drawer assembly 60 and fan assembly 40 are selectively movable along the support members 30 in unison, i.e. they move up or down together.

Figure 5A:
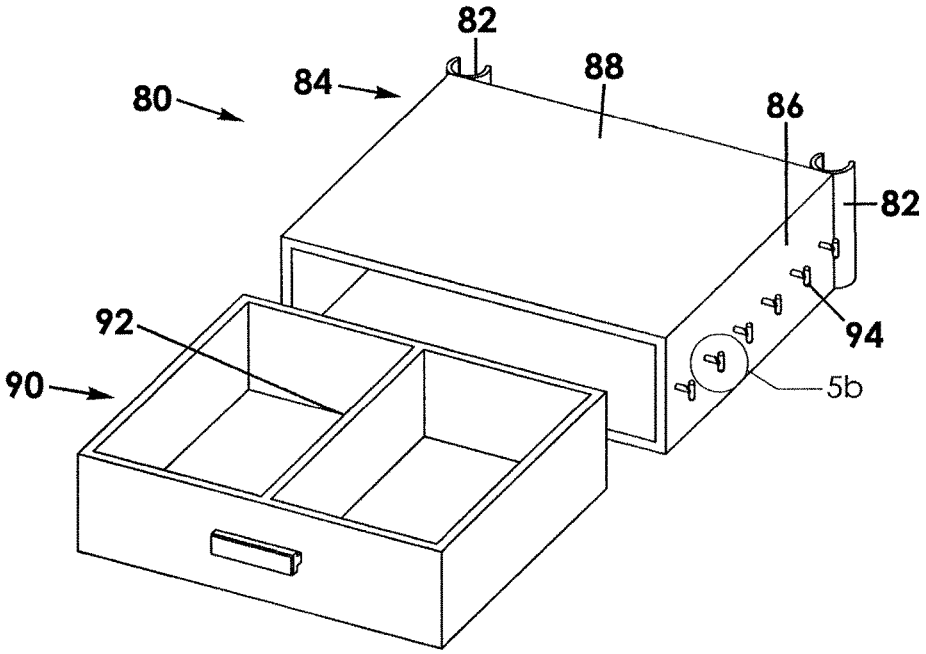
FIG. 5*a* is an exploded view of an accessory drawer assembly removed from the support members.
Figure 5B:
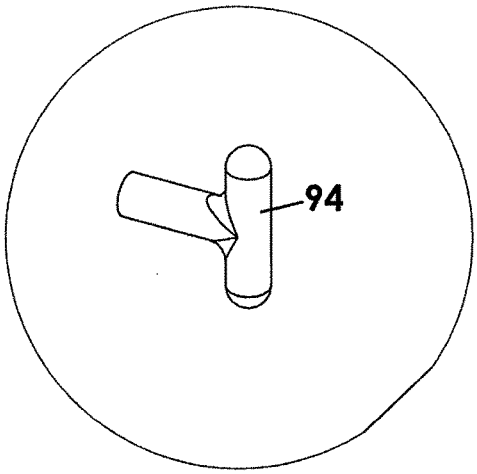
FIG. 5*b* is an isolated view on an enlarge scale taken from FIG. 5*a;*
Figure 5C:
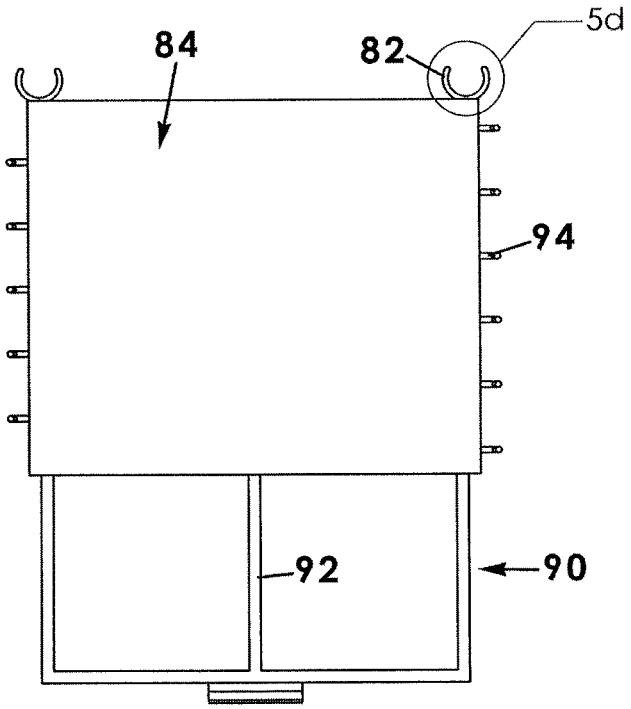
FIG. 5*c* is a top view of the accessory drawer assembly as in FIG. 5*a*.
Figure 5D:
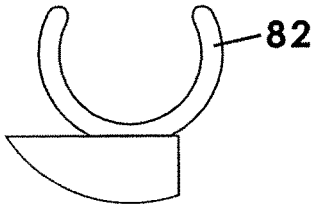
FIG. 5*d* is an isolated view on an enlarge scale taken from FIG. 5*c*.

In one embodiment, the fan support and storage apparatus 10 includes at least one accessory drawer assembly 80 coupled to the support members 30 and configured to move slidably between first 32 and second 36 ends thereof in a manner substantially similar to that described previously. Unlike the fan drawer assembly 60, however, the accessory drawer assembly 80 is separate and displaced from the fan assembly 40 and is independently slidably movable. As with the fan drawer assembly 60 described previously, the accessory drawer assembly 80 may include a fastener 82 that may be removably coupled to the support members 30, such as a clip, a clamp, a collar, or the like (FIG. 5*c*).

More particularly, the accessory drawer assembly 80 includes an accessory drawer housing 84 having opposed side walls 86 and opposed top 88 and bottom walls, the walls collectively defining an open front and an interior area. The accessory drawer assembly 80 includes an accessory drawer 90 selectively received in the interior area of the accessory drawer assembly 80 through the open front thereof. The accessory drawer 90 includes a front wall and a bottom wall that together define an interior space configured to receive articles therein, such as jewelry or make-up. A partition 92 may be situated in the interior space so as to divide the interior space into multiple compartments for organizational purposes (FIG. 5*a*). A plurality of hooks 94 may be coupled to respective side walls of the accessory drawer housing 84, each hook being configured to hold jewelry accessories, such as ear rings, rings, necklaces, or the like (FIG. 5*a* to 5*c*). A different quantify of hooks 94 may be included on opposite sides of the accessory drawer housing 84.

In some embodiments, multiple accessory drawer assemblies may be coupled to the support members 30. Each accessory drawer assembly 80 may be independently attached and moved with regard to each other drawer assembly or the fan assembly 40. In another embodiment, two or more accessory drawer assemblies may be coupled to one another and moved in unison along the support members 30.

In use, the fan support and storage apparatus 10 may be positioned in an upright configuration supported upon the base member 20. If appropriate fixtures are available, the mounting member 39 may be coupled to a minor or wall for added stability. The fan assembly 40 may be slidably positioned to a desired vertical position along the support members 30. This adjustability enables a user to decide if she wants air to be circulated on her torso, neck, face, or just circulated within a room Likewise, the fan member 48 may be tilted and swiveled as described above. In addition, the fan drawer assembly 60 and one or more accessory drawer assembly 80 may be coupled to the support members 30 and slidably positioned vertically as desired. It is understood that each fastener by which an assembly is coupled to a support member may be configured for a friction fit engagement; in other words, the assembly will be held at a desired position by friction. Of course, in some embodiments, clamps, pins, or the like may be used to hold a position.

It is understood that while certain forms of this invention have been described, it is not limited thereto except insofar as such limitations are included in the following claims and allowable functional equivalents thereof.

The invention claimed is:

1. A fan support and storage apparatus for use in cooling a user's torso while the user is positioned adjacent the apparatus, comprising:

a base member having upper and lower portions;

a tubular support member having a first end operatively coupled to said base member and a second end opposite said first end, said support member having an elongate tubular configuration extending upwardly from said base member and supported in a generally vertical configuration above said base member;

a fan assembly slidably coupled to said support member and selectively movable therealong between said first end and said second end of said support member; and a fan drawer assembly slidably coupled to said support member adjacent said fan member, said fan drawer assembly being slidably movable between said first end and said second end of said support member.

2. The fan support and storage apparatus as in claim 1, wherein said support member is a pair of spaced apart support members, each support member having a first end operatively coupled to said base member and having a tubular configuration.

3. The fan support and storage apparatus as in claim 1, wherein said fan drawer assembly includes:

a fan drawer housing having a pair of opposed side walls and opposed top and bottom walls that define an open front and an interior area; and a fan drawer selectively received in said interior area of said fan drawer housing through said open front, said fan drawer having a front wall and a bottom wall that together define an interior space configured to receive articles therein.

4. The fan support and storage apparatus as in claim 3, wherein said fan drawer housing includes a shelf member coupled to a respective side wall of said fan drawer housing, said shelf member defining a plurality of spaced apart holes configured to secure jewelry accessories.

5. The fan support and storage apparatus as in claim 1, further comprising a mounting member coupled to said second end of said support member, said mounting member selectively coupled to one of a wall or a mirror.

6. The fan support and storage apparatus as in claim 5, wherein said mounting member is a suction cup.

7. The fan support and storage apparatus as in claim 1, wherein said fan assembly includes:

a carriage slidably coupled to said support member; and a fan member pivotally coupled to said carriage and configured such that said fan member is selectively movable between upwardly, downwardly, and neutral tilted configurations.

8. The fan support and storage apparatus as in claim 7, wherein said fan member is coupled to said carriage so as to swivel between leftwardly, rightwardly, and neutral configurations.

9. The fan support and storage apparatus as in claim 7, wherein:

said carriage has a generally U-shaped configuration and defines an inner groove thereabout; and said fan assembly includes a boss connecting said fan member to said carriage, said boss being received in said inner groove, said boss being configured to selectively slide along said groove and to selectively pivot relative to said groove.

10. The fan support and storage apparatus as in claim 1, wherein said fan drawer assembly includes:

a fan drawer housing having a rear end slidably coupled to said support member; and a pair of guard members extending downwardly from opposed side walls of said fan drawer housing and configured to shield lateral sides of said fan member.

11. The fan support and storage apparatus as in claim 10, wherein each guard member is constructed of a mesh material.

12. The fan support and storage apparatus as in claim 10, wherein said fan drawer housing is operatively coupled to said fan assembly such that said fan assembly and said fan drawer assembly are slidably moved along said support member in unison.

13. The fan support and storage apparatus as in claim 12, wherein said fan drawer housing includes at least one fastener removably coupled to said support member and configured to selectively slide along said support member.

14. A fan support and storage apparatus for use in cooling a user's torso while the user is positioned adjacent the apparatus, comprising:

a base member having upper and lower portions;

a tubular support member having a first end operatively coupled to said base member and a second end opposite said first end, said support member having an elongate tubular configuration extending upwardly from said base member and supported in a generally vertical configuration above said base member;

a fan assembly slidably coupled to said support member and selectively movable therealong between said first end and said second end of said support member; and an accessory drawer assembly slidably coupled to said support member and displaced from said fan member, said fan drawer assembly being slidably movable between said first end and said second end of said support member.

15. The fan support and storage apparatus as in claim 14, wherein said accessory drawer assembly includes:

an accessory drawer housing having a pair of opposed side walls and opposed top and bottom walls that collectively define an open front and an interior area; and an accessory drawer selectively received in said interior area of said accessory drawer housing through said open front, said accessory drawer having a front wall and a bottom wall that together define an interior space configured to receive articles therein.

16. The fan support and storage apparatus as in claim 15, comprising a plurality of jewelry hooks spaced apart on respective side walls of said accessory drawer housing, each jewelry hook being configured to secure jewelry accessories.

* * * * *